US005447146A

United States Patent [19]

Nickerson

[11] Patent Number: 5,447,146

[45] Date of Patent: Sep. 5, 1995

[54] OVEN RACK ASSEMBLY

[76] Inventor: Larry D. Nickerson, 5701 Beaver Dam La., Charlotte, N.C. 28227

[21] Appl. No.: 192,424

[22] Filed: Feb. 7, 1994

[51] Int. Cl.[6] ..... F24C 15/16

[52] U.S. Cl. ..... 126/339; 126/332; 126/337 R

[58] Field of Search ..... 126/339, 332, 337 R, 126/340, 337 A

[56] References Cited

U.S. PATENT DOCUMENTS

| | | | |
|---|---|---|---|
| 972,923 | 10/1910 | Ritter . | |
| 1,409,203 | 3/1922 | Schey | 126/339 X |
| 1,657,226 | 1/1928 | Neldner . | |
| 1,938,470 | 12/1933 | Teller | 126/340 |
| 2,106,506 | 1/1938 | Pletcher et al. | 126/339 X |
| 2,348,720 | 5/1944 | Bobo | 126/337 |
| 2,362,047 | 11/1944 | Center | 45/90 |
| 2,414,433 | 1/1947 | Bargen | 45/91 |
| 2,486,564 | 11/1949 | Kamin | 126/339 X |
| 2,498,243 | 2/1950 | Brinker | 312/29 |
| 2,598,266 | 3/1950 | Kamin | 126/334 |
| 2,819,141 | 1/1958 | Myer | 126/339 X |
| 2,919,966 | 1/1960 | Preston | 126/337 A |
| 2,987,363 | 6/1961 | Morse | 126/337 X |
| 3,188,161 | 6/1965 | Powder | 312/306 |
| 3,428,382 | 2/1969 | Yarnell | 312/208 |
| 3,558,204 | 1/1971 | Elliott | 312/208 |
| 4,243,281 | 1/1981 | Egger | 312/208 |

*Primary Examiner*—Larry Jones
*Attorney, Agent, or Firm*—Ralph H. Dougherty

[57] ABSTRACT

An oven rack assembly to support cooking vessels within an oven that is capable of being pulled outwardly and upwardly exterior to the oven's interior heating chamber. The rack is situated within a frame generally conforming to the shape and size of the interior cooking region of a conventional oven. Generally L-shaped arms are pivotally attached to the rack and the frame, the arms being of a shape and dimension to allow the rack, when pulled and removed from the interior of the oven, to be raised to any one of several heights, including a height approximately equal to that of the upper exterior surface of the oven, while maintaining a horizontal orientation at all times. The assembly has a locking mechanism to allow the user to raise the rack to any one of several convenient heights.

36 Claims, 3 Drawing Sheets

OVEN RACK ASSEMBLY

FIELD OF THE INVENTION

The present invention relates to an oven rack assembly for supporting cooking vessels in an oven. The invention more particularly relates to a rack assembly mounted within an oven that is hinged to allow the horizontal rack to be pulled outwardly and raised upwardly exterior to the oven. The assembly has a locking mechanism to allow the user to raise the rack to any one of several convenient heights, the top height being at least equal to that of the top surface of the exterior of the oven.

BACKGROUND OF THE INVENTION

The oven is one of the most used appliances in the home. Most of the meals prepared in the home necessitate the use of an oven for heating and cooking. Many ovens are situated on or near the floor of the kitchen and are provided with slidable racks for supporting cookware. These slidable racks, when pulled outwardly by the user, allow the cookware to be moved from the interior heating chamber of the oven for monitoring, handling, or removal, but the low height of the racks requires awkward bending, leaning, and stooping on the part of the user to grasp the cookware and further requires lifting of the cookware from the low rack surface to a countertop or tabletop. Furthermore, cooking vessels, when filled with food, can be quite heavy, hot to the touch, and difficult to handle, thereby making the use of low oven racks awkward and possibly dangerous, especially for the handicapped, the elderly, and those with physical ailments such as arthritis.

An oven rack assembly that is easily movable to allow the horizontal rack to be pulled outwardly and raised upwardly to a more convenient height exterior to the oven would solve these problems by allowing the user to raise the rack to a convenient height exterior to the oven for prior to loading the cookware or handling the cookware stationed thereon.

DESCRIPTION OF THE PRIOR ART

Applicants are aware of the following U.S. Patents concerning apparatus relevant to the invented oven rack assembly.

| U.S. Pat. No. | Issue Date | Inventor | Title |
|---|---|---|---|
| 972,923 | 10-18-1910 | Ritter | TYPE WRITER CABINET |
| 1,657,226 | 01-24-1928 | Neldner | ADJUSTABLE RACK |
| 1,938,470 | 12-05-1933 | Teller | GAS OR ELECTRICAL COOKING APPARATUS |
| 2,348,720 | 05-16-1944 | Bobo | ADJUSTABLE BROILER GRID HOLDING RACK |
| 2,362,047 | 11-07-1944 | Center | DESK CONSTRUCTION |
| 2,414,433 | 01-21-1947 | Bargen | TYPEWRITER DESK |
| 2,498,243 | 02-21-1950 | Brinker | FOLDING TYPEWRITER PLATFORM FOR PEDESTAL DESKS |
| 2,598,266 | 05-27-1952 | Kamin | RANGE AND RANGE TOP EXTENSION |
| 3,188,161 | 06-08-1965 | Powder | VERTICALLY ADJUSTABLE SHELF |
| 3,428,382 | 02-18-1969 | Yarnell | RETRACTABLE TYPEWRITER SUPPORT FOR DESKS |
| 3,558,204 | 01-26-1971 | Elliot | DESK ASSEMBLY |

-continued

| U.S. Pat. No. | Issue Date | Inventor | Title |
|---|---|---|---|
| 4,243,281 | 01-06-1981 | Egger | TYPEWRITER CABINET |

Ritter, U.S. Pat. No. 972,923 shows a cabinet for housing a typewriter that has a typewriter support adapted to horizontally slide in and out of the cabinet on rollers.

Neldner, U.S. Pat. No. 1,657,226 teaches an adjustable oven rack for adjusting the position of a vessel within the oven for uniform cooking. The rack is vertically adjustable within the interior of the oven by turning an exterior handwheel connected to the rack by meshing pinions and screw rods.

Teller, U.S. Pat. No. 1,938,470 discloses a broiler pan that is automatically pulled horizontally from the interior of the oven when the oven door is opened. This device also has brackets with slots to allow the user to place the pan at varying heights within the oven.

Bobo, U.S. Pat. No. 2,348,720 shows a grid carrying rack for radiant broilers. The rack can be moved vertically within the interior of the oven to place the food the desired distance from the heat source. The vertical movement of the rack is accomplished by rotating a handle exterior to the oven which is connected to a shaft and a cam which raises the rack mechanism.

Center, U.S. Pat. No. 2,362,047 discloses a desk construction having a typewriter supporting board that is horizontally slidably attached near the upper surface of the desk.

Bargen, U.S. Pat. No. 2,414,433 teaches a typewriter desk in which the typewriter is secured to a base board slidable in the desk, the base board being movable rearwardly and engagable in a rotary cradle, the cradle being rotatable to position the typewriter in a substantially inverted position.

Brinker, U.S. Pat. No. 2,498,243 discloses a folding typewriter platform for pedestal desks. The platform is a horizontal support surface slidably attached to a track in the interior of the desk to allow the surface to be horizontally pulled exterior to the desk. The platform is hinged to allow it to occupy a vertical position within the desk when not in use.

Kamin, U.S. Pat. No. 2,598,266 teaches a shelf hingedly attached to a range that forms an extension of a range top.

Powder, U.S. Pat. No. 3,188,161 shows a vertically adjustable shelf for the food storage compartment of a refrigerator.

Yarnell, U.S. Pat. No. 3,428,382 discloses a retractable typewriter support assembly for desks. The support surface is horizontally adjustable and vertically adjustable and securable at varying heights.

Elliot, U.S. Pat. No. 3,558,204 teaches a desk assembly used to support a typewriter and which extends horizontally from the desk and which can be stored inside a desk cavity. The assembly is slidable from an inner storage position and is hinged to a carrier which is slidably attached to the desk frame.

Egger, U.S. Pat. No. 4,243,281 discloses a typewriter cabinet which internally houses a typewriter when not in use and has a support surface upon which the typewriter rests hingedly attached to a front wall. The support surface with the typewriter resting thereon can be rotated to form a horizontal top surface for access to the typewriter.

SUMMARY OF THE INVENTION

The present invention includes an oven rack to support cooking vessels within an oven. The rack, comprising a rack member and a grid, is situated within a frame generally conforming to the shape and size of the interior heating chamber of a traditional oven. On each of its left and right sides, the rack is hingedly attached to a pair of generally L-shaped arms that are also hingedly attached to the left and right side portions of the frame, respectively. The arms are of a shape and dimension to allow the rack, when pulled and removed from the interior of the oven, to rise to a height approximately equal to that of the upper exterior surface of the oven, while maintaining a horizontal orientation at all times.

A horizontal locking bar secures the position of the rack by fitting within any one of several locking gaps located on a flange on the end of each rear arm where the arm attaches to the rack member. The locking bar engages the flanged end of each rear arm by sliding through retaining slots in the rack member. A threaded rod connects the locking bar to the ends of a handle, which extend through holes in the front portion of the rack member. When a user pulls on the handle, the locking bar is pulled free from the locking gaps and the arms are thereby allowed to pivot, causing the rack to extend outwardly and upwardly. Torsion springs are placed in communication with each rear arm and the frame, such that the springs supply a lifting force to the rack, which aids the user in extending and raising the rack. When the rack has been raised to a sufficiently convenient height, the user releases the handle, which, by spring loading, is pulled toward the rear of the rack engaging the locking bar in the locking gaps of the flanges, thereby securing the position of the rack. When the user wishes to replace the rack into the interior of the oven, the user pulls the handle outward, disengaging the locking bar from the locking gaps on the flange, allowing the rack to be pushed downwardly and inwardly into the oven. Releasing the spring loaded handle causes the locking bar to re-engage the locking gaps thereby securing the rack.

OBJECTS OF THE INVENTION

The principal object of the present invention is to provide an oven rack assembly that can be pulled outwardly and raised upwardly exterior to the heating chamber of an oven.

Another object of the invention is to provide an oven rack assembly that can be raised to any one of multiple heights.

A further object of this invention is to provide a moveable oven rack assembly that requires minimal effort to effect the pulling and raising thereof.

Another object of the invention is to provide a moveable oven rack assembly that provides a means to quickly stop and secure the rack if the user ceases to control the motion of the rack assembly.

Another object of the invention is to provide an oven rack assembly that can be raised exterior to the oven to a height so as to reduce the need for prolonged bending or stooping by the oven user.

BRIEF DESCRIPTION OF THE DRAWINGS

The foregoing and other objects will become more readily apparent by referring to the following detailed description and the appended drawings in which.

DETAILED DESCRIPTION

Figure 1:
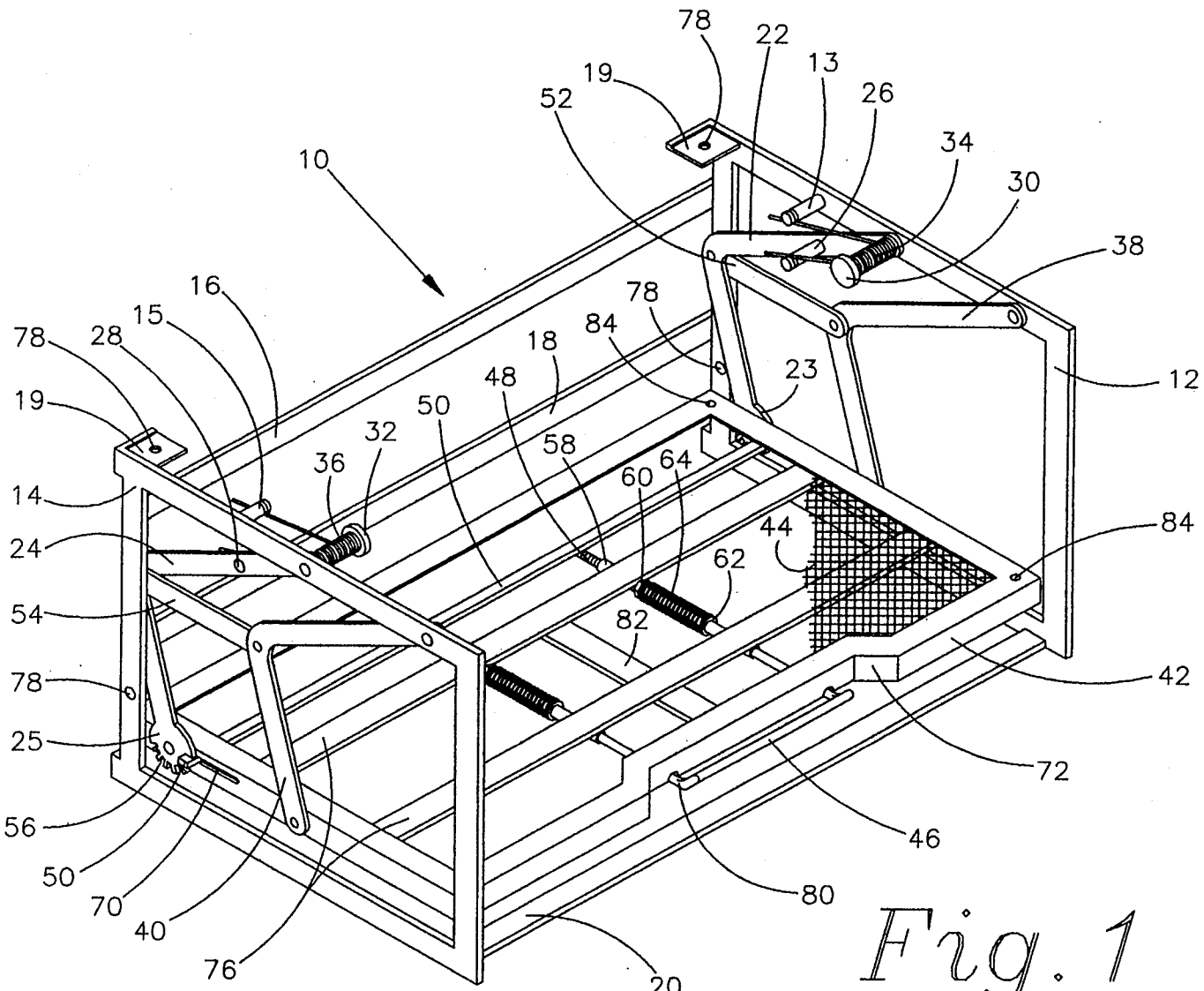
FIG. 1 is an isometric view of the oven rack assembly.
Figure 2:
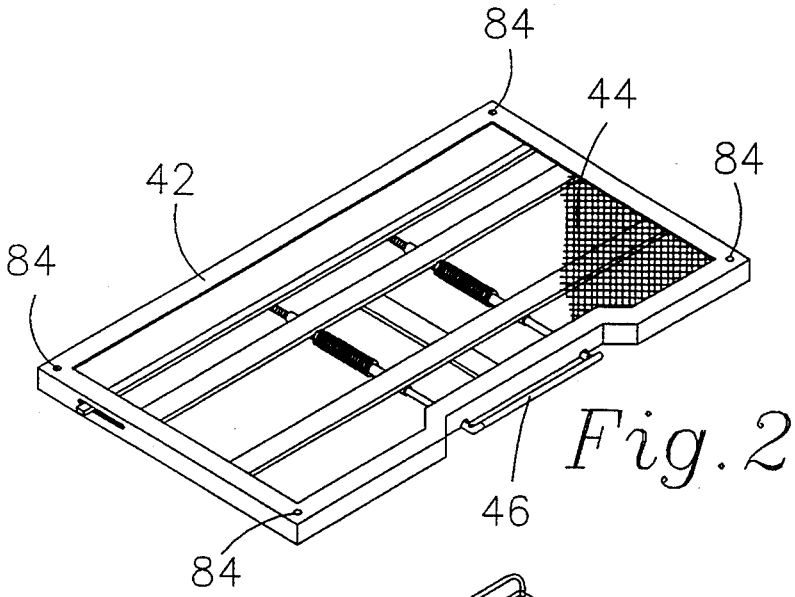
FIG. 2 is a top view of the rack member and grid.

The present invention is an oven rack assembly that resides entirely within the interior heating region of an oven, the right and left halves of which are mirror images of each other. FIG. 1 shows an oven rack assembly 10 having a frame generally conforming to the shape and size of the interior heating chamber of an oven comprising a right frame portion 12, a left frame portion 14, and connecting frame support members 16, 18, 20. The connection of these components can be accomplished by bolting, riveting, welding, or any other suitable method of attachment of metal parts. The assembly, when placed within an oven, is braced against the interior side walls of the oven by feet 74 attached to screws threaded through holes 78 in frame portions 12, 14, and is likewise braced against the interior upper wall by footed screws 74 threaded through holes 78 in frame tabs 19, attached perpendicularly to the top edges of frame portions 12, 14. Situated horizontally within the frame is a rack for supporting cooking vessels comprising a rack member 42 attached to which is a grid 44, as shown in FIG. 2. Pivotally connected to the outside of the right and left sides of rack member 42 are rear arms 22 and 24, respectively and front arms 38 and 40, respectively. The arms 22, 38 and 24, 40 are generally L-shaped and are further pivotally connected to the inside of the top portions of the right and left frame portions, 12 and 14, respectively.

Figure 3:
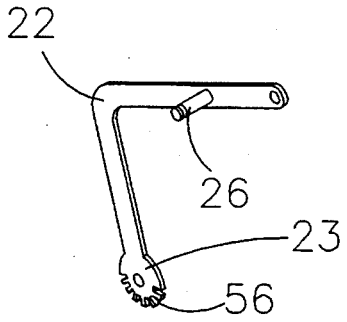
FIG. 3 is an isometric view of the right rear arm.
Figure 4:
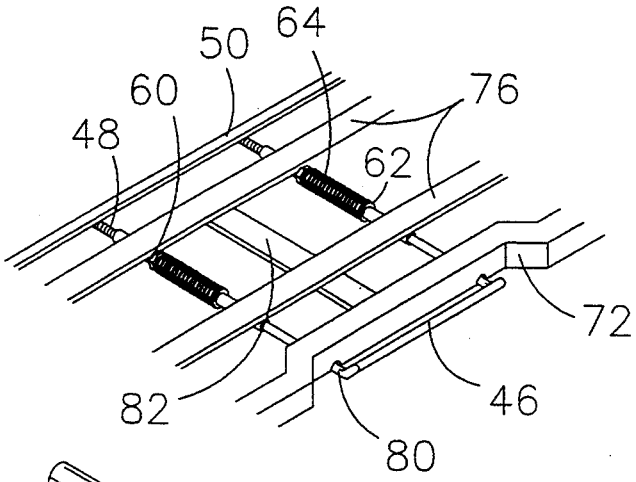
FIG. 4 is a side view of the right rear arm.
Figure 5:
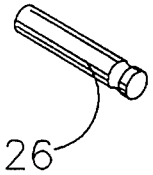
FIG. 5 is a side view of the grooved stud attached to the right rear arm.
Figure 7:
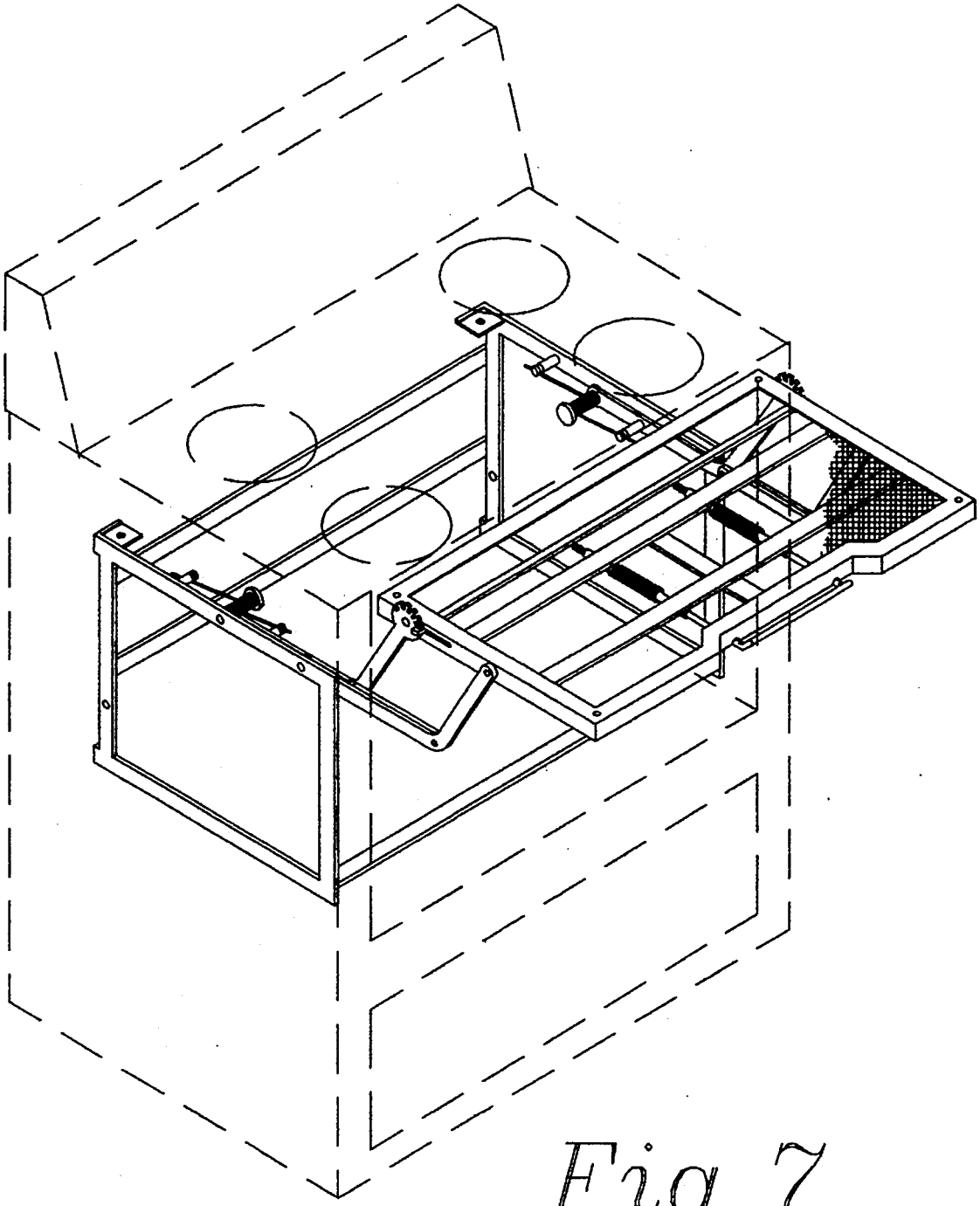

Stabilizing bars 52 and 54 are connected between the inside of arms 22 and 38 and arms 24 and 40, respectively, at or near the curved portion of each L-shaped arm. Attached to the inside of rear arms 22, 24 at their point of connection to the top portion of frame portions 12, 14 are mandrels 30 and 32, respectively. Fitted around these mandrels are coiled torsion springs 34, 36. The ends of spring 34 are slidably situated in a grooved stud 13 perpendicularly attached to the inside of the top portion of right frame portion 12 and grooved stud 26 perpendicularly attached to the inside of right rear arm 22, as shown in FIGS. 3, 4, and 5. Similarly, spring 36 is slidably situated between grooved studs 15 and 28.

The ends of rear arms 22, 24 that pivotally attach to the rack member 42 have thereupon expanded flanges 23 and 25, respectively. These flanges are generally circular in shape and each has a plurality of locking gaps 56 around its periphery. These locking gaps 56 are sufficient in width to accept the ends of the locking bar 50 therebetween. The locking bar is a thin component situated within rack member 42 having ends extending through slots 70 of rack member 42. The slots 70 are sufficient in length to allow the locking bar 50 to be slidably moved toward the front of the assembly so as to fully clear locking gaps 50, thereby allowing the arms to pivot freely.

Near its midpoint, the locking bar 50 is perpendicularly fixed to the ends of threaded rods 48. These rods terminate at, and are fixed to, the ends 80 of a handle 46. The handle ends 80 are situated partially below rack member 42, with the ends 80 extending through generally semicircular notches 72 in the front portion of rack member 42. The threaded rods are slidably situated within non-continuous segments of hollow metal tubing 58, which are fixedly attached to brace members 76, which are connected between the left and right sides of the bottom of rack member 42. Brace 82 is fixedly connected between the front and rear portions of rack member 42. Placed over the rods and against the exposed ends of tubing 58 are washers 62, which serve as stops for springs 64 placed over the threaded rods 48, held in compression by nuts 60 threaded onto the rods.

In the middle of the front portion of rack member 42 is a concave notched region that is wider than the width of the handle 46. The ends 80 of the handle extend through notches 72 located in the concave notched region of the rack member 42. This notched region provides adequate clearance from the rack for a user's fingers and knuckles when gripping the handle. Further, the notched region allows the handle to be positioned such that it does not extend past the front portion of the rack member, thus, the handle does not prevent closure of the oven door. Additionally, the shape of the handle is such that the gripping area is raised slightly above the level of the rack. This allows for extra clearance for a user's fingers above the opened oven door when gripping the handle.

All components of the oven rack assembly are constructed of a material, such as steel, that is sufficient in strength to support the forces exerted by cookware resting on the grid as well as those forces exerted by a user pulling and lifting the rack. The material must also be able to withstand the elevated temperatures commonly found in an oven.

In operation, when the rack rests in a locked position, the compression springs 64, held by washers 62, press rearwardly against nuts 60 threadably secured onto rods 48. The springs supply a constant force which pushes the nut, and thus the rods 48 and the locking bar 50 toward the rear of the assembly, thereby pressing the bar into the locking gaps 56 on flanges 23, 25. This prevents any pivoting or rotation of arms 22, 24 and thus secures the horizontal rack member 42 and attached grid 44 in a stable horizontal position.

When it is desired to remove and raise the rack from the locked position in the interior of the oven, the user grasps and pulls the handle 46. The handle is held in a rearward position by the compression springs 64, therefore, some force is necessary to pull the handle outwardly. When the handle is pulled outwardly a sufficient distance, the locking bar, which is attached to the handle via threaded rods 48, slides forward in slots 70 and becomes disengaged from locking gaps 56. Upon disengagement of the locking bar 50 from the locking gaps 56, the rack is free to move outwardly and upwardly by the user applying continuous outward pressure to the handle. The arms pivot about their pivot points and torsion springs 34, 36 supply a force against studs 26 and 28 thus aiding the rotation of arms 22, 24 and thus the lifting of the rack. Front arms 38, 40 also rotate and serve to maintain the rack in a horizontal orientation at all times.

When the rack has been raised to a sufficiently convenient height, the user releases the handle 46, which is again forced rearward by the compression springs 64 pushing on the nuts 60. The nuts are threaded onto rods 48 which are attached to the locking bar 50, thus, any movement of the nuts is equaled by similar movement of the locking bar. This pushes the locking bar rearward and causes the bar to fit within one of the locking gaps 56 on flanges 23, 25. This prevents any further pivoting or rotation of the arms and therefore locks the rack in position.

This spring-activated locking action acts as a safety feature of the present invention. The spring-activated system will lock the rack securely in place whenever outward force on the handle is absent, whether by intention or by mistake or accident. When the force on the handle 46 is removed, the compression springs will immediately force the nuts 60, and thus the locking bar 50, rearward and the bar will come to rest in the first available locking gap 56 on the flanges 23, 25, thereby securing the rack and preventing it from descending more than a few inches. This will prevent any spills or breakage of cooking vessels placed on the rack which could lead to burns, falls, as well as an inconvenient mess.

The nuts 60 can be tightened or loosened on the threaded rods 48 in order to increase or reduce the requisite force that must be applied to the handle in order to compress the springs 64 a sufficient distance in order to effect disengagement of the locking bar from the locking gaps, thereby allowing rotation of the arms and the raising of the rack.

ALTERNATIVE EMBODIMENTS

Figure 6:
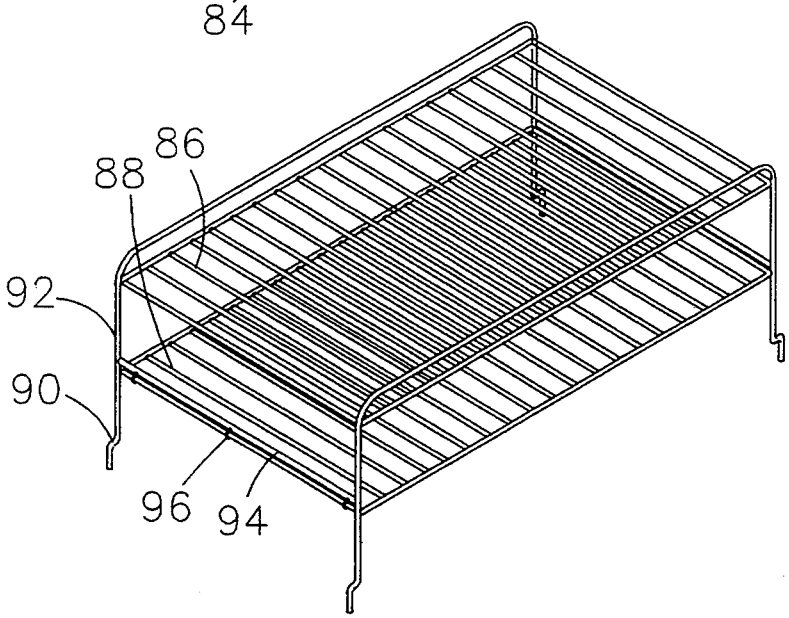
FIG. 6 is a front view of the second rack attachment.

In addition to placing cooking vessels on the grid 44 attached to the rack member 42, a second rack 68 for supporting additional cookware can be placed upon the rack member. The second rack can be a single or multiple shelf unit to allow the user to maximally utilize the cooking region of the oven. FIG. 6 shows a second rack 68 having four legs 92, each leg having a step-shaped end 90, for placement within holes 84 on the rack member. The second rack has an upper shelf 86 integrally formed with legs 92. Between the front and rear legs on each side of the second rack is connected a bar 94. Attached to the bar are support hooks 96 for receiving and supporting the sides of a removable lower shelf 88.

Since the arms 22, 24, 38, 40 are shaped such that the rack is first pulled outwardly and then raised upwardly, the additional height of the second rack will not prevent the entire rack unit from being removed and raised exterior to the oven.

The oven rack assembly 10 can also be adapted to fit within a wide variety of ovens, not merely those conventional ovens found within the home. The assembly is adaptable to fit within commercial ovens or within any heating chamber where the support of the objects to be heated is desired.

SUMMARY OF THE ACHIEVEMENT OF THE OBJECTS OF THE INVENTION

From the foregoing, it is readily apparent that I have invented an improved oven rack assembly capable of being easily pulled outward and upward to any one of several convenient heights. It is also readily apparent that I have invented an oven rack assembly that is automatically secured should the user cease to maintain control of the handle.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. An oven rack assembly for installation within the heating chamber of an oven comprising:

a horizontal rack, comprising a rack member having a front portion and a rear portion, and a grid attached to said rack member for supporting cooking vessels;

means for supporting said rack within the oven;

means for pivotally connecting said rack to said supporting means, said pivotal connecting means being L-shaped; and means for securing said rack in a fixed horizontal position.

2. The oven rack assembly according to claim 1 wherein said pivotally connecting means comprises a plurality of arms having upper and lower ends, said lower ends being pivotally connected to said rack member and said upper ends being pivotally connected to said supporting means.

3. The oven rack assembly according to claim 2 further comprising a torsion spring in communication with said arm and said supporting means, whereby said torsion spring biases said supporting means against said arm.

4. The oven rack assembly according to claim 2 wherein at least one of said arms has an enlarged flange at said lower end, said flange having a plurality of locking gaps around its periphery.

5. The oven rack assembly according to claim 4 wherein said securing means comprises a locking bar extending through said rack member, said locking bar engaging said locking gaps of said flange of said arm, thereby preventing any pivotal movement of said arm.

6. The oven rack assembly according to claim 5 further comprising a means for selectably engaging and disengaging said securing means.

7. The oven rack assembly according to claim 6 further comprising a handle in communication with said securing means, said handle extending past the front portion of said rack member, wherein said engaging means is controlled by movement of said handle.

8. The oven rack assembly according to claim 7 wherein said engaging means comprises said handle in communication with said locking bar, said locking bar and said handle being slidable in a forward and rearward direction.

9. The oven rack assembly according to claim 8 wherein said locking bar is attached to one end of at least one rod, the other end of said rod being attached to an end of said handle.

10. The oven rack assembly according to claim 9 further comprising at least one compression spring situated around each said rod, whereby forward sliding movement of said handle is opposed by said spring.

11. The oven rack assembly according to claim 10 wherein said rod is exteriorly threaded, further comprising at least one nut threaded onto said threaded rod, said nut abutting and acting to compress said spring, whereby the force exerted by said spring opposing any forward sliding movement of said handle is adjustable by movement of said nut on said rod and whereby the force exerted by said spring on said nut acts to push said locking bar rearward into one of said locking gaps.

12. The oven rack assembly according to claim 1 further comprising a means for selectably engaging and disengaging said securing means.

13. The oven rack assembly according to claim 1 further comprising a handle in communication with said securing means.

14. The oven rack assembly according to claim 13 wherein said front portion of said rack member has a concave notch therein, said handle extending past said notch, thereby allowing adequate clearance of a user's fingers when gripping said handle.

15. The oven rack assembly according to claim 13 wherein said handle has two ends and a gripping portion, said handle being shaped such that said gripping portion is situated above said ends of said handle.

16. The oven rack assembly according to claim 1 wherein said supporting means comprises a frame situated within the heating chamber of the oven.

17. The oven rack assembly according to claim 16 further comprising bracing means for securing said frame against the interior heating chamber of the oven.

18. The oven rack assembly according to claim 17 wherein said bracing means comprises screws with feet attached thereto, said screws being threaded through holes in said frame.

19. The oven rack assembly according to claim 1 further comprising a second rack having at least one horizontal surface, and legs, the ends of said legs being removably connected to said rack member.

20. An oven rack assembly for installation within the heating chamber of an oven comprising:

a horizontal rack, comprising a rack member having a front portion and a rear portion, and a grid attached to said rack member for supporting cooking vessels;

means for supporting said rack within the oven;

means for pivotally connecting said rack to said supporting means, said pivotal connecting means comprising a plurality of arms having upper and lower ends, said lower ends being pivotally connected to said rack member and said upper ends being pivotally connected to said supporting means, at least one of said arms having an enlarged flange at said lower end, said flange having a plurality of locking gaps around its periphery; and means for securing said rack in a fixed horizontal position.

21. The oven rack assembly according to claim 20, further comprising a torsion spring in communication with said arm and said supporting means, whereby said torsion spring biases said supporting means against said arm.

22. The oven rack assembly according to claim 21, wherein said securing means comprises a locking bar extending through said rack member, said locking bar engaging said locking gaps of said flange of said arm, thereby preventing any pivotal movement of said arm.

23. The oven rack assembly according to claim 22, further comprising means for selectively engaging and disengaging said securing means.

24. The oven rack assembly according to claim 23, further comprising a handle in communication with said securing means, said handle extending past the front portion of said rack member, wherein said engaging means is controlled by movement of said handle.

25. The oven rack assembly according to claim 24, wherein said engaging means comprises said handle in communication with said locking bar, said locking bar and said handle being slidable in a forward and rearward direction.

26. The oven rack assembly according to claim 25, wherein said locking bar is attached to one end of at least one rod, the other end of said rod being attached to an end of said handle.

27. The oven rack assembly according to claim 26, further comprising at least one compression spring situated around each said rod, whereby forward sliding movement of said handle is opposed by said spring.

28. The oven rack assembly according to claim 27, wherein said rod is exteriorly threaded, further comprising at least one nut threaded onto said threaded rod, said nut abutting and acting to compress said spring, whereby the force exerted by said spring opposing any forward sliding movement of said handle is adjustable by movement of said nut on said rod and whereby the force exerted by said spring on said nut acts to push said locking bar rearward into one of said locking gaps.

29. The oven rack assembly according to claim 28, wherein said bracing means comprises screws with feet attached thereto, said screws being threaded through holes in said frame.

30. The oven rack assembly according to claim 20, further comprising means for selectably engaging and disengaging said securing means.

31. The oven rack assembly according to claim 20, further comprising a handle in communication with said securing means.

32. The oven rack assembly according to claim 31, wherein said front portion of said rack member has a concave notch therein, said handle extending past said notch, thereby allowing adequate clearance of a user's fingers when gripping said handle.

33. The oven rack assembly according to claim 31, wherein said handle has two ends and a gripping portion, said handle being shaped such that said gripping portion is situated above said ends of said handle.

34. The oven rack assembly according to claim 20, wherein said supporting means comprises a frame situated within the heating chamber of the oven.

35. The oven rack assembly according to claim 34, further comprising bracing means for securing said frame against the interior heating chamber of the oven.

36. The oven rack assembly according to claim 20, further comprising a second rack having at least one horizontal surface, and legs, the ends of said legs being removably connected to said rack member.

* * * * *